United States Patent [19]

Penzias

[11] 4,036,118

[45] July 19, 1977

[54] ROD-LIKE ARTICLES

[75] Inventor: Rolf Penzias, London, England

[73] Assignee: Molins Limited, England

[21] Appl. No.: 665,860

[22] Filed: Mar. 11, 1976

[30] Foreign Application Priority Data

Mar. 15, 1975 United Kingdom ..... 10896/75

[51] Int. Cl.[2] ..... F01B 29/00

[52] U.S. Cl. ..... 93/77 FT; 93/1 C; 198/461

[58] Field of Search ..... 93/1 C, 77 FT; 198/459, 198/461

[56] References Cited

U.S. PATENT DOCUMENTS

| | | | |
|---|---|---|---|
| 2,547,729 | 4/1957 | Aiken | 198/459 |
| 2,957,285 | 10/1960 | Molins | 93/1 C |
| 3,354,887 | 11/1967 | Hall | 93/1 C X |
| 3,367,245 | 2/1968 | Wisdom | 93/1 C |
| 3,872,779 | 3/1975 | Jackson | 93/1 C |

*Primary Examiner*—Roy Lake
*Assistant Examiner*—Paul A. Bell
*Attorney, Agent, or Firm*—Craig & Antonelli

[57] ABSTRACT

A cam track is used for accurately timing and conveying a stream of alternating filter portions in the production of composite filter rod. Groups of filter portions are supplied to the cam track, which forms a continuous stream by reducing the feed velocity and delivers the stream into the garniture of a rod-making machine. The cam track mechanism and the continuous rod cut-off are synchronised so that the rod is cut at predetermined positions, e.g. through the middle of alternate filter portions.

12 Claims, 5 Drawing Figures

40
44
48
52
54
50
46
42
58
62
60
56
64
71
78
82
80
70
76
74
72

ROD-LIKE ARTICLES

This invention relates to apparatus for feeding rod-like articles. In particular the invention is concerned with the formation of a composite rod composed of at least two different types of component rod-like articles.

Filter portions for attachment to plain cigarette lengths often comprise two or more different components, usually in axial abutment. Such portions, referred to as composite filter portions, may be produced from a continuous rod comprising a continuous wrapper surrounding, for example, a succession of alternate component filter portions of different materials. The rod is subsequently cut at regular intervals, for example through the middle of every portion of one of the filter materials, to form filter lengths for use by a filter attachment machine. In this machine the filter lengths are introduced between and joined to two plain cigarette lengths and then cut in half to produce two filter cigarettes, each half of the filter length being attached to a cigarette length and comprising a composite filter portion having two half portions of the different filter materials. The present invention is applicable to the assembly and feeding of component filter portions to form a composite filter rod.

It should be understood that the composite filter rod is usually cut by a continuous rod cut-off mechanism, to produce the composite filter lenghts referred to above, whilst the rod is moving at high speed. In order that the rod should be cut precisely in the correct positions in relation to the different components of the rod it is important that the feed of the components and the cut-off mechanism are accurately synchronised. In order to achieve this, individual component filter portions or groups thereof may be positively fed in predetermined order and in timed sequence onto a continuous wrapper just prior to entry into a garniture where the wrapper is continuously wrapped around the component filter portions. Where a continuous stream of abutting filter components is required the velocities of the feed means and the continuous wrapper must be such that the gaps between groups delivered by the feed means disappear before the components are wrapped.

According to the present invention apparatus for feeding rod-like articles in successsion comprises a drive member rotatable about an axis, a cam track surrounding the axis, a plurality of feed members connected to the rotatable drive member and constrained to follow a course determined by the cam track when the drive member is rotated about its axis, and means for feeding groups of endwise-moving rod-like articles onto a path associated with part of said course, each feed member being arranged to engage the trailing end of the rear article of a group at a pick-up point on said path and convey said group along said path past a release point on said path, the distance between said path and said axis progressively decreasing over at least part of said path between said pick-up point and said release point.

Groups of, for example, four or six rod-like articles may be fed onto the path in succession. It is conceivable that a group could comprise a single rod-like article. Where the drive member is rotated at constant velocity the speed of the groups fed on said part of the path between the pick-up point and the release point is progressively reduced. Thus gaps between successive groups are reduced on said part of said path.

The feed members are preferably fingers or other projections extending from drive links pivotally connected to the drive member. The course of the feed members preferably follows the cam track. At the release point the course of the feed members and the path of the rod-like articles preferable diverge.

Where the present apparatus is employed as feed means for collating groups of component filter portions prior to the formation of composite filter rod, the groups are preferably delivered by the feed members onto a continuous wrapper for the rod. For production of a continuous composite rod comprising an abutting stream of component filter portions the rate of supply of filter portions to the feed apparatus should be equal to the rate of flow of filter portions through the garniture in which the rod is formed. Thus, as there are gaps between the groups delivered to the feed apparatus, the initial velocity of the filter portions on the feed apparatus is higher than their speed through the garniture. Hence the speed of filter portions conveyed by the feed members is reduced from the initial velocity to garniture velocity; this is achieved by the reducing distance between the axis and the path in the feed apparatus. The final velocity of the filter portions as conveyed by the feed members may be less than garniture velocity but collation, i.e. timing by engagement of the feed member behind a continuous stream of filter portions stretching into the garniture, takes place at a collation point where the velocity of the feed member equals that of the garniture tape.

The distance between the collation point and first contact with further feeding means, such as the continuous wrapper, is preferably approximately equal to the length of a group. The path between the release point and the continuous wrapper is preferably straight.

The invention will now be further described with reference to the accompanying drawings in which.

The invention is described with reference to the feeding and assembly of a composite rod including two different filter materials, but it should be understood that the invention can in principle be used also in the assembly of a rod with only one type of filter material or with three or more different filter materials. The term "filter" is used through the specification to include any mouthpiece suitable for attachment to a tobacco section to produce a tipped cigarette, irrespective of whether the mouthpiece does, or is intended to, act as a filter.

Figures 1, 2:
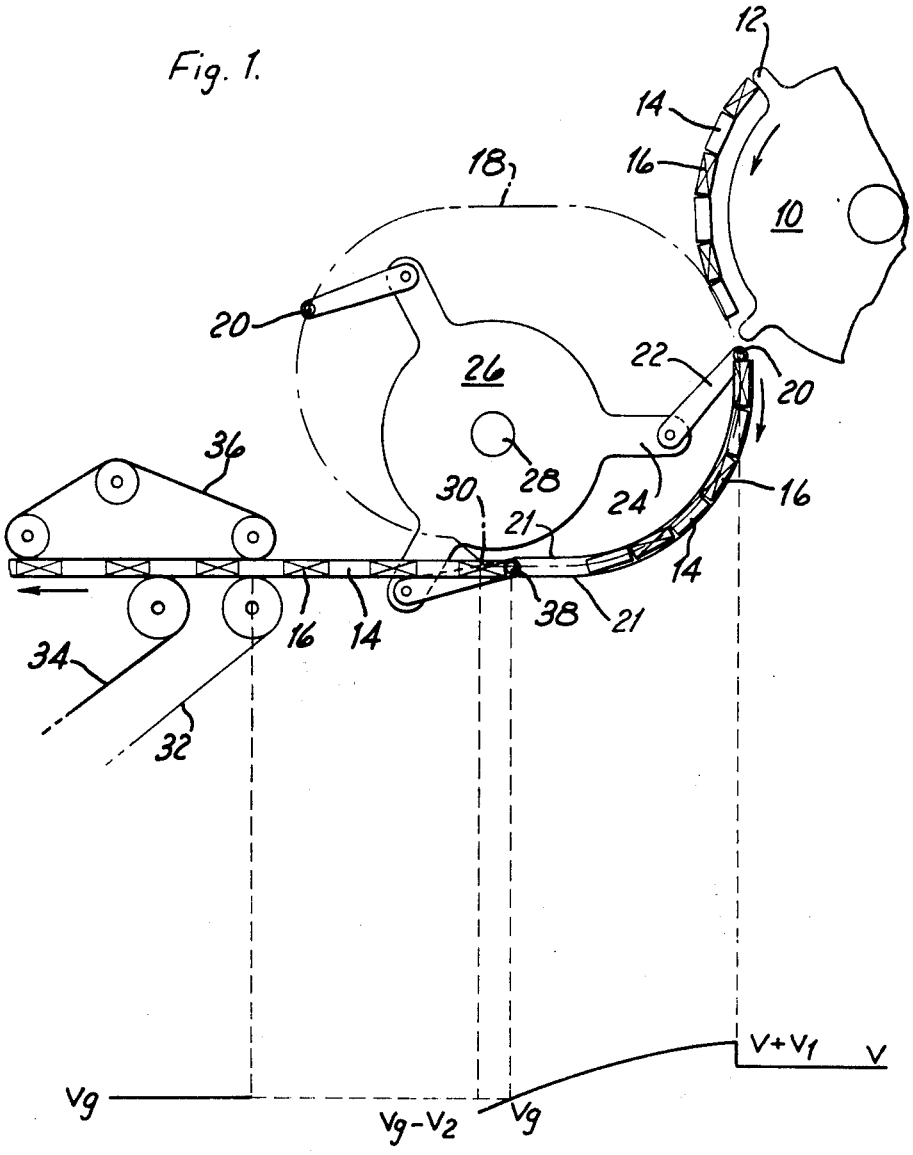
FIG. 1 is a diagram of apparatus for feeding component filter portions.
FIG. 2 is a diagram indicating the velocities of articles fed by the apparatus of FIG. 1.

FIG. 1 shows a turntable 10 having radially extending fingers 12 for feeding forward groups of six alternate component filter portions 14, 16 of different materials. Successive groups are fed by the turntable 10 on to a path which follows a cam track 18, along which path the groups are conveyed by a feed member 20 which engages the trailing end of the rear filter portion in a group. There are three feed members 20 operating on the cam track 18, each feed member being attached to a drive link 22, which in turn is pivotally connected to one of three symmetrically-disposed radial arms 24 on a drive member 26 rotatable on axis 28.

The paths along which the groups of filter portions are conveyed by the feed members 20 is defined by guide elements which are indicated at 21 in the drawing. The course followed by the feed members 20, as defined by the cam track 18, and the path along which the groups move, as defined by the guide elements, diverge at a release point 30, at which the feed members 20 move out of engagement with the rear filter portion of a group. From the release point 30 the path followed by the groups of filter portions 14, 16 is straight and leads onto a continuous wrapper 32 carried by a garniture tape 34 and under a top control band 36.

It will be appreciated that FIG. 1 is diagrammatic and that normally the turntable 10 and cam track 18 will be in a horizontal plane (and will therefore be rotatable about vertical axes) whilst the bands 34 and 36 and the wrapper 32 lie in substantially vertical planes and pass around horizontal axes.

The rate of delivery of filter portions by the turntable 10 is equal to the rate of flow of filter portions through the garniture on the wrapper 32 and garniture tape 34. Referring now also to FIG. 2, which diagrammatically indicates the velocities of filter portions passing through the apparatus of FIG. 1, the velocity of filter portions delivered by the turntable 10 is V: this is greater than the velocity of filter portions conveyed by the garniture tape V*g* since there are gaps (between groups) in the flow from the turntable. At the pick-up point, where a group is transferred from the turntable into the path of a feed member 20, there is a slight increase in velocity to $V + v_1$. This makes the transfer slightly easier but fact $v_1$ could be zero. As the drive member 26 rotates and carries the feed member 20 beyond the pick-up point the velocity of the feed member is progressively reduced as the distance between the cam track 18 and the axis 28 decreases. At a position 38 the velocity is equal to the velocity of the garniture tape V*g*. This is the collation point and in this position the feed member 20 has closed any gaps betwen the group it is conveying and the previous group (and any gaps still remaining in or between previous groups) and instantaneously conveys a continuous stream up to the garniture (and beyond) at garniture velocity.

As can be seen by reference to FIG. 2 the velocity of the feed member 20 falls below garniture velocity V*g* between the collation point 38 and the release point 30 to a value $Vg - v_2$. In an alternative arrangement $v_2$ could be zero. In fact the collation point could in theory be substantially coincident with the release point, but with the apparatus of FIG. 1 is is preferred that, at the collation point, the feed member 20 is in engagement with the centre of the trailing article in a group.

It will be noted from FIG. 1 that the distance between the collation point 38 and the start of the wrapper 32 and the band 36 is slightly less than the length of a group. Thus the leading filter portion of a group is gripped by the wrapper and band and conveyed at garniture velocity before the velocity of the feed member falls below garniture velocity. The remainder of the group is subsequently conveyed at the decreasing velocity of the feed member 20 until this passes the release point after which the group remainder is stationary for a short time between the release point 30 and the wrapper 32, (and is supported on a dead plate). It will be understood that the distance between the release point and the wrapper may be such that one or more of the remainder of the group may be gripped and conveyed by the band 36 and wrapper 32 before the feed member 20 reaches the release point.

Thus, after a feed member 20 has just passed the release point 30, there will be a number of gaps in the stream between the next feed member 20 and the continuous stream in the garniture. There is one gap between the group conveyed by the said next feed member and the remainder of the previous group stationary just beyond the release point. There is another gap between this stationary group remainder and the last filter portion to be gripped by the band 36 and wrapper 32. If said last filter portion was not the leading member of the previous group there will be a gap between it and the next filter portion on the wrapper and there may be further gaps between filter portions on the wrapper up to the last filter portion to be positively collated by the feed member which has just passed the release point. In the arrangement described this last positively collated filter portion is the leading filter portion of the group conveyed by the feed member but with varying distances between the wrapper and the collation point it could be any filter portion in the conveyed group, or even a member of a previous group, or even a member of a previous group.

All the gaps in the stream are closed when the next feed member reaches the collation point, the gaps having been closed whilst said next feed member is moving at a velocity in excess of garniture velocity V*g*, and at that position the whole stream in front of the feed member is moving at garniture velocity V*g*. It is at this position that the accurate synchronisation or timing between the drive member 26 and the cut-off in the garniture is related to the feed of the alternating stream. It will be realised that some movement of filter portions relative to the wrapper, under action of the feed members, will be required to close gaps, e.g. between the last positively collated filter portion and the next filter portion. The dimensions of the apparatus should be such that these gaps are closed before they progress too far into the garniture, i.e. at least before reaching the position where longitudinal sealing is completed.

Figures 3, 4, 5:
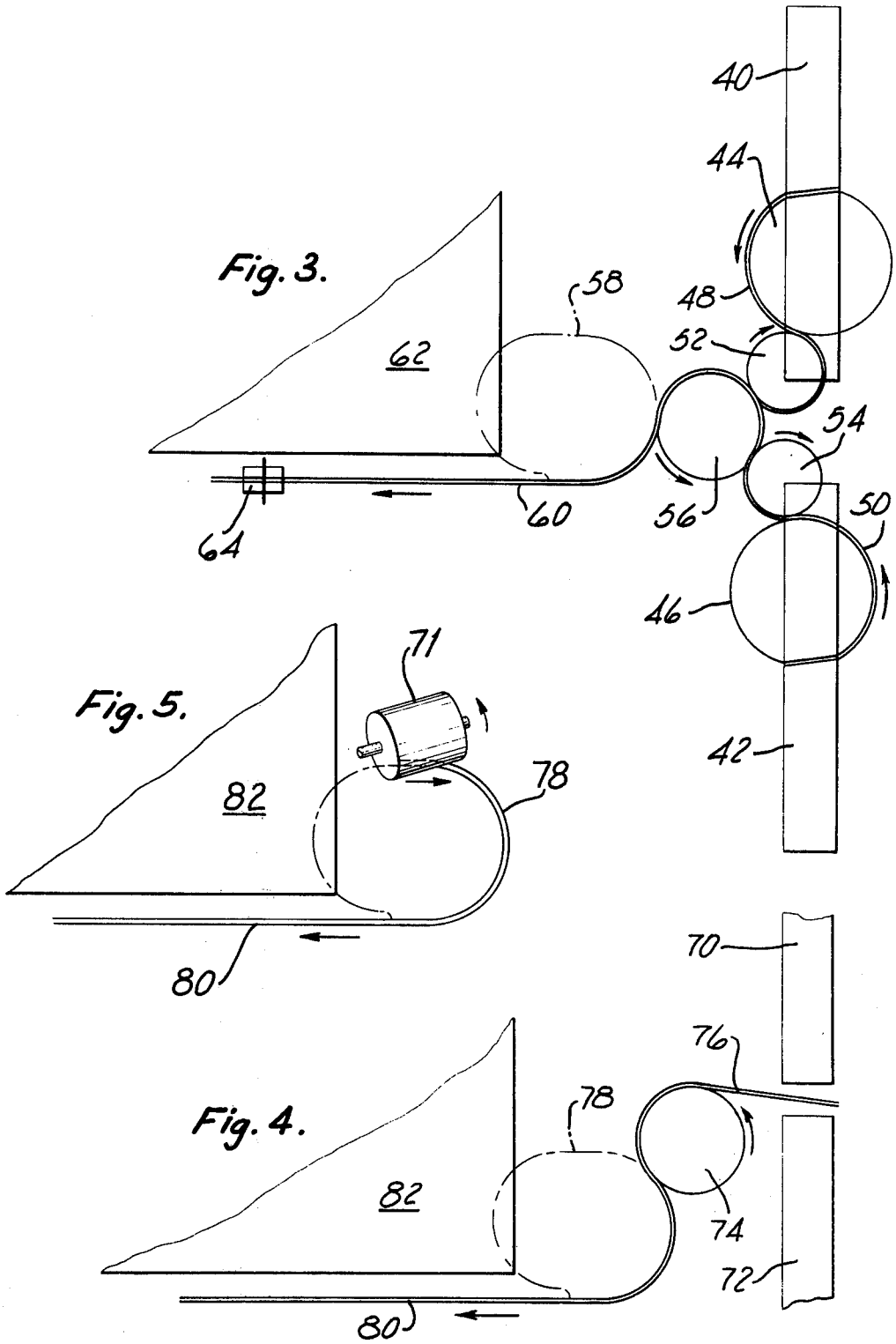
FIG. 3 is a diagrammatic view in plan of part of a machine for producing composite filter rod.
FIGS. 4 and 5 are similar views of parts of other machines.

FIG. 3 shows part of a machine for producing composite filter rod, in which the apparatus of FIG. 1 is incorporated. Hoppers 40 and 42 hold first and second types of filter portions respectively. Filter portions or groups of filter portions are delivered from the hoppers 40, 42 by cam track means 44, 46 respectively to form continuous closed streams of filter portions as indicated at 48 and 50 respectively. The stream 48 is fed tangentially onto a wheel 52. At the point of transfer of the stream onto the wheel 52 the filter portions are subjected to axial separation by use of pressure air to cause an air flow which separates adjacent filter portions to create a stream of spaced filter portions on the wheel 52. Similarly air separation is used at the point of transfer of the stream 50 onto a delivery wheel 54. One arrangement whereby axial separation of rod-like articles may be achieved by use of pressure air is described in British patent specification No. 955,431.

The stream of spaced filter portions are delivered from the wheels 52, 54 onto a turntable 56 on which the streams are intercalated to form an alternating stream of filter portions. The turntable 56 may be the same as the turntable 10 of FIG. 1 and may collect the alternating stream in groups of six. These groups are delivered to a cam track mechanism 58 similar to that shown in FIG. 1, which collates the stream and delivers a substantially closed stream of alternating filter portions (as shown at 60) towards a machine bed 62 where the stream is enclosed in a continuous wrapper web to form a continuous composite filter rod. A continuous cut-off mechanism is indicated at 64: this is synchronised with the cam track mechanism 58 to ensure correct cutting of the composite rod.

It will be appreciated that, as well as or instead of air separation between the cam tracks 44, 46 and the wheels 52, 54 the required spacing between adjacent filter portions may be achieved by differential peripheral speeds of the wheels 52, 54 and cam tracks 44, 46. In an alternative arrangement, similar to that disclosed in U.S. Pat. No. 3,872,779 (British Pat. No. 9315/73), the cam tracks 44, 46 may be replaced by chains, and a series of turntables as shown in FIG. 3 of the aforementioned specification relied upon to provide the stream of spaced filter portions. The cone shown in the said FIG. 3 could be used to deliver groups of filter portions to the cam track mechanism 58, instead of to the turntable 56.

In the arrangement shown in FIG. 4 a pair of hoppers 70, 72 is arranged to supply filter portions of first and second types respectively to a series of drums (not shown) which re-arrange the filter portions to deliver groups of alternating filter portions. These groups are delivered directly from the output drum to a turntable 74 by a chain 76. The turntable 74 may be similar to that shown in FIG. 1 and delivers the groups of alternating filter portions to a cam track feed mechanism 78, also similar to that of FIG. 1. Thus a collated substantially closed stream of alternating filter portions (as shown at 80) is delivered towards a machine bed 82, as before, for formation into a composite filter rod.

The chain 76 could be replaced by a cam track mechanism similar to those shown in FIG. 3 at 44 or 46. Alternatively, as shown in FIG. 5, the collating cam track mechanism 78 could be directly fed from the output drum 71 from the hoppers 70, 72. The feed members of the drive member of the cam track mechanism 78 shown in FIG. 5 are arranged to pass through the flutes of drum 71 to engage the rod-like articles. There is then be no need for the chain 76 and turntable 74.

Where the groups of end to end rod-like articles are delivered to the cam track mechanism in a direction transverse to their lengths, the groups need not comprise abutting articles, any gaps being closed up as the feed member engages the rear article and conveys it along its path.

I claim:

1. Apparatus for feeding rod-like articles in succession comprising a drive member rotatable about an axis, a cam track surrounding the axis, a plurality of feed members connected to the rotatable drive member and constrained to follow a course determined by the cam track when the drive member is rotated about its axis, guide means defining a path associated with part of said course, and means for feeding groups of in line rod-like articles onto said path, each feed member being arranged to engage the trailing end of the rear article of a group at a pick-up point on said path and convey said group along said path past a release point on said path, the distance between said path and said axis progressively decreasing over at least part of said path between said pick-up point and said release point.

2. Apparatus as claimed in claim 1 wherein the drive member includes a plurality of pivotally mounted drive links, and said feed members comprise projections extending from said drive links.

3. Apparatus as claimed in claim 1 wherein the course of the feed members follows said cam track.

4. Apparatus as claimed in claim 1 wherein the course of the feed members and the path of the rod-like articles diverge as said release point.

5. Apparatus as claimed in claim 1 further comprising a stationary surface onto which said path extends after said release point.

6. Apparatus as claimed in claim 5 further comprising conveyor means for receiving groups of rod-like articles from said path on said stationary surface.

7. Apparatus as claimed in claim 6 wherein said path from said release point to said conveyor means is substantially straight.

8. Apparatus as claimed in claim 6 wherein said conveyor means includes means for supporting a continuous wrapper web.

9. Apparatus as claimed in claim 8 and further comprising a continuous rod cut-off associated with said conveyor means, said cut-off including drive means synchronised with drive means for said rotatable drive member.

10. Apparatus as claimed in claim 1 wherein said means for feeding rod-like articles onto said path includes a rotatable turntable having radially-extending fingers.

11. Apparatus as claimed in claim 1 wherein said means for feeding rod-like articles onto said path includes means for delivering groups of rod-like articles in a direction transverse to their lengths.

12. Apparatus as claimed in claim 11 wherein said feeding means comprises a fluted drum, the feed members of said rotatable drive member being arranged to pass through the flutes to engage said rod-like articles.

* * * * *